US008427013B2

(12) United States Patent
Watanabe et al.

(10) Patent No.: US 8,427,013 B2
(45) Date of Patent: Apr. 23, 2013

(54) POWER SUPPLY CIRCUIT AND ELECTRONIC DEVICE

(75) Inventors: Masatoshi Watanabe, Kanagawa-ken (JP); Mitsuru Sugawara, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 357 days.

(21) Appl. No.: 12/832,290

(22) Filed: Jul. 8, 2010

(65) Prior Publication Data

US 2011/0009171 A1 Jan. 13, 2011

(30) Foreign Application Priority Data

Jul. 9, 2009 (JP) ..... 2009-162371

(51) Int. Cl.

| | |
|---|---|
| ***H01H 31/10*** | (2006.01) |
| ***H01H 33/59*** | (2006.01) |
| ***H01H 47/00*** | (2006.01) |
| ***H01H 85/46*** | (2006.01) |
| ***H01H 19/14*** | (2006.01) |

(52) U.S. Cl.
USPC ..... 307/115

(58) Field of Classification Search ..... 307/115, 307/116; 320/114; 323/238
See application file for complete search history.

(56) References Cited

U.S. PATENT DOCUMENTS

2007/0188135 A1* 8/2007 Odaohhara ..... 320/114
2010/0208502 A1* 8/2010 Horii ..... 363/131

FOREIGN PATENT DOCUMENTS

JP 2008-178196 7/2008

* cited by examiner

*Primary Examiner* — Carlos Amaya
(74) *Attorney, Agent, or Firm* — Turocy & Watson, LLP

(57) ABSTRACT

According to one embodiment, a power supply circuit includes a power switch section, an error amplifier, a wiring and a reset switch section. The error amplifier has one input portion connected to the output terminal, the other input portion and an output portion. The error amplifier outputs the control potential via the output portion to make the resistance of the power switch section high so that potential applied to the one input portion is high to potential applied to the other input portion. The wiring connects a reference terminal to the other input portion. In addition, the reset switch section is configured to isolate the wiring from a baseline potential when the input terminal is supplied with a potential, and to connect the wiring to the baseline potential when the input terminal is not supplied with the potential.

13 Claims, 6 Drawing Sheets

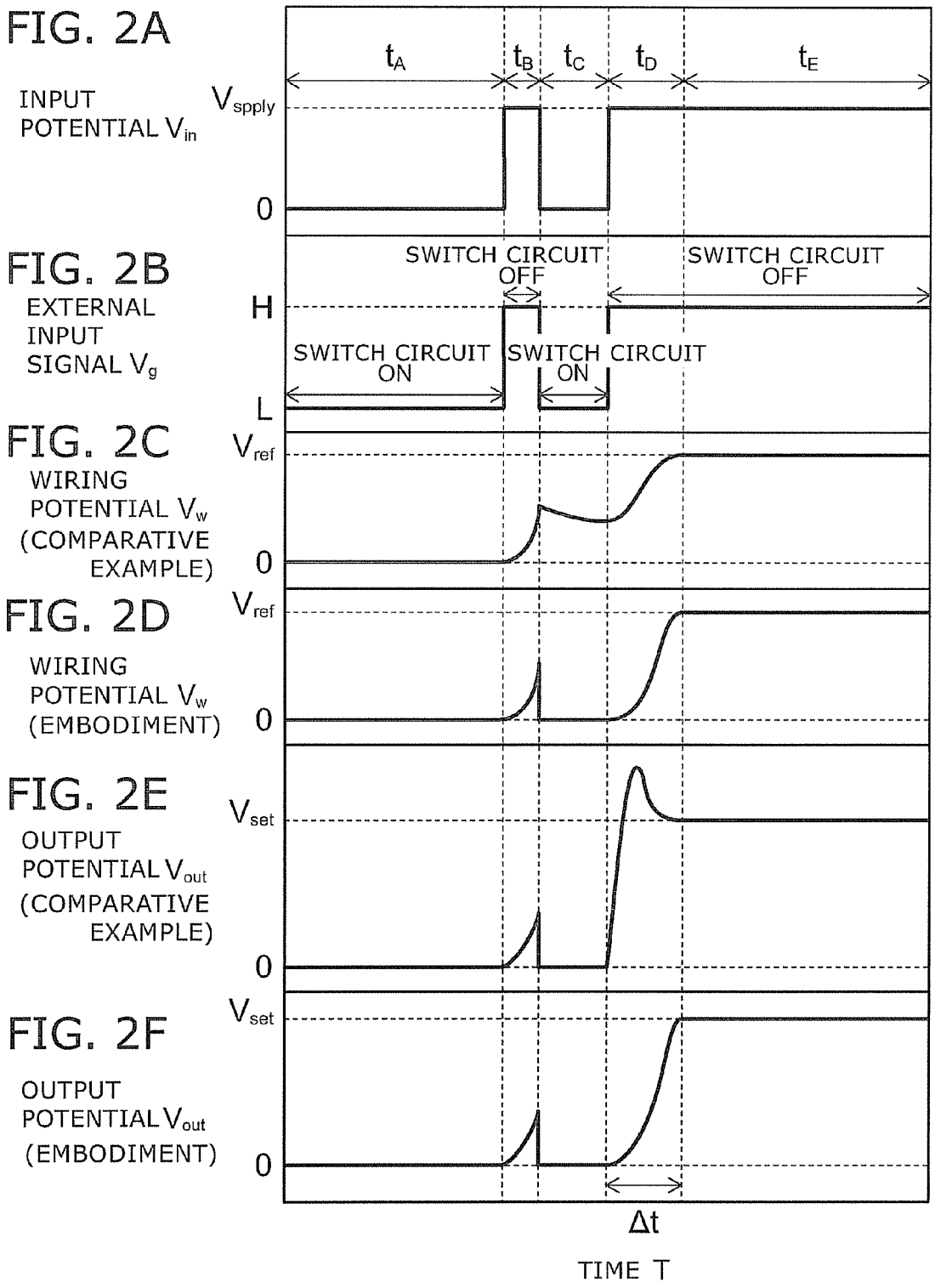
FIG. 2A
INPUT POTENTIAL $V_{in}$
$V_{spply}$
0
$t_A$
$t_B$
$t_C$
$t_D$
$t_E$
FIG. 2B
EXTERNAL INPUT SIGNAL $V_g$
H
L
SWITCH CIRCUIT OFF
SWITCH CIRCUIT OFF
SWITCH CIRCUIT ON
SWITCH CIRCUIT ON
FIG. 2C
WIRING POTENTIAL $V_w$ (COMPARATIVE EXAMPLE)
$V_{ref}$
0
FIG. 2D
WIRING POTENTIAL $V_w$ (EMBODIMENT)
$V_{ref}$
0
FIG. 2E
OUTPUT POTENTIAL $V_{out}$ (COMPARATIVE EXAMPLE)
$V_{set}$
0
FIG. 2F
OUTPUT POTENTIAL $V_{out}$ (EMBODIMENT)
$V_{set}$
0
Δt
TIME T

POWER SUPPLY CIRCUIT AND ELECTRONIC DEVICE

CROSS-REFERENCE TO RELATED APPLICATIONS

This application is based upon and claims the benefit of priority from the prior Japanese Patent Application No. 2009-162371, filed on Jul. 9, 2009; the entire contents of which are incorporated herein by reference.

FIELD

Embodiments described herein relate generally to a power supply circuit and an electronic device having the power supply circuit.

BACKGROUND

A mobile electronic device, such as a cellular phone, includes a rechargeable battery as a power supply, and is used by repetitively recharging the rechargeable battery. In recharging the rechargeable battery, typically, a dedicated adaptor is used to supply a prescribed recharging voltage to the electronic device.

Users manually connect an electronic device to the adaptor for recharging the electronic device. For instance, the users bring the recharging electrode of the electronic device into contact with the electrode of a recharging dock by mounting the electronic device on the recharging dock. Or users insert a plug of an adaptor into a recharging terminal of the electronic device. However, in these operations, the connection state between the adaptor and the electronic device may become unstable, and the recharging voltage is intermittently inputted to the electronic device. Thereby, a high inrush voltage may be generated in the electronic device. And the inrush voltage may be applied to parts of the electronic device.

BRIEF DESCRIPTION OF THE DRAWINGS

FIGS. 2A to 2F are timing charts illustrating the variation of potentials;

DETAILED DESCRIPTION

In general, according to one embodiment, a power supply circuit includes a power switch section, an error amplifier, a wiring and a reset switch section. The power switch section is connected between an input terminal and an output terminal and is configured to vary resistance in response to an inputted control potential. The error amplifier has one input portion connected to the output terminal, the other input portion and an output portion. The error amplifier outputs the control potential via the output portion to make the resistance of the power switch section high so that potential applied to the one input portion is high to potential applied to the other input portion. The wiring connects a reference terminal to the other input portion. In addition, the reset switch section is configured to isolate the wiring from a baseline potential when the input terminal is supplied with a potential, and to connect the wiring to the baseline potential when the input terminal is not supplied with the potential.

According to another embodiment, an electronic device includes the above power supply circuit and a rechargeable battery connected to an output terminal of the power supply circuit.

Embodiments will now be described with reference to the drawings.

At the outset, a first embodiment is described.

Figure 1:
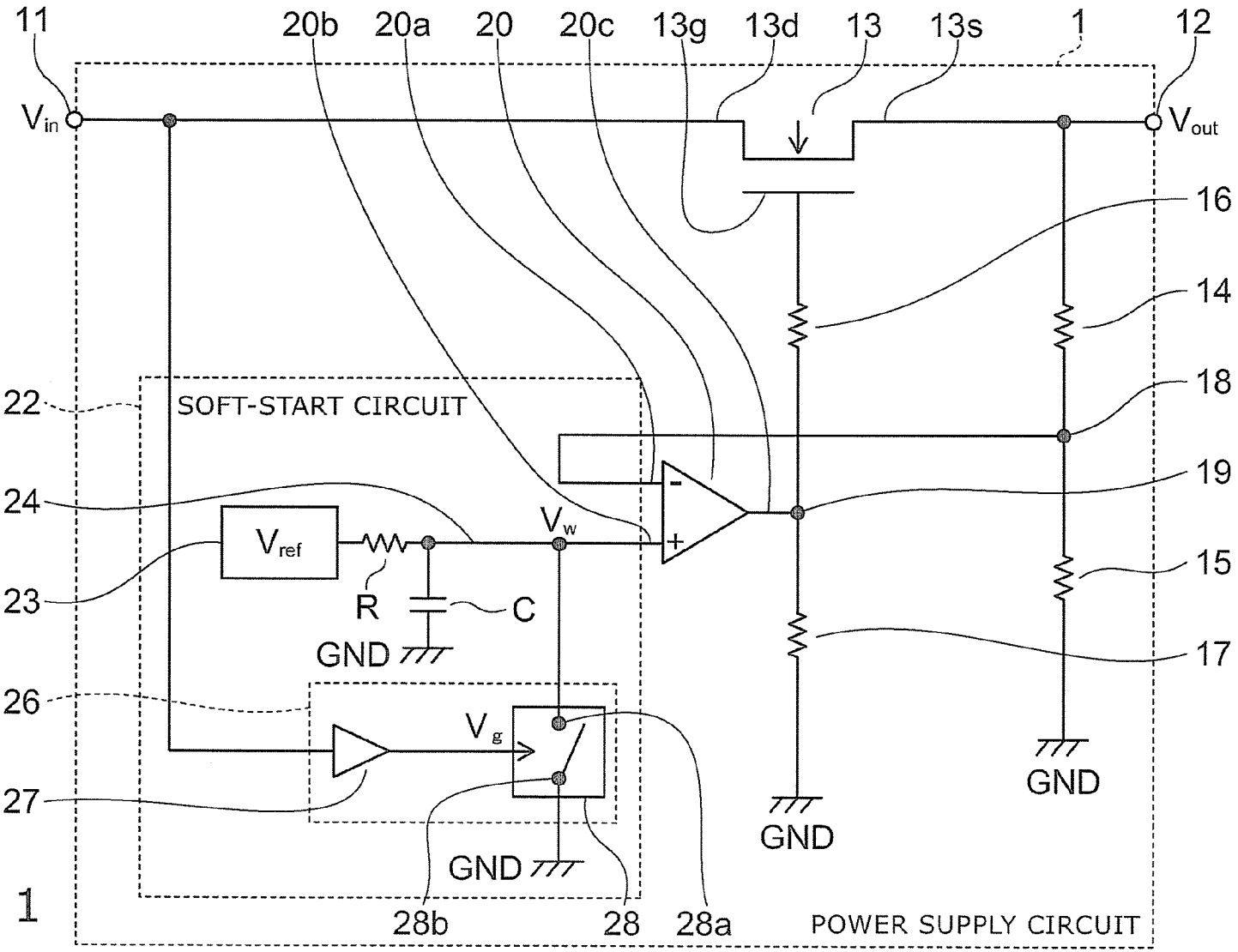
FIG. 1 is a circuit diagram illustrating a power supply circuit according to a first embodiment.

FIG. 1 is a circuit diagram illustrating a power supply circuit according to this embodiment.

As shown in FIG. 1, the power supply circuit 1 according to this embodiment is a power supply circuit for outputting a constant output potential $V_{out}$ in response to input of an unknown or indefinite input potential $V_{in}$. For instance, the power supply circuit 1 is a power supply circuit mounted in a cellular phone. For example, a set potential $V_{set}$ of the output potential $V_{out}$ is illustratively 5 V. A supply potential $V_{spply}$ externally supplied as the input potential $V_{in}$ may be higher than the set potential $V_{set}$, and is illustratively 10 V.

As shown in FIG. 1, the power supply circuit 1 includes an input terminal 11 for being inputted potential $V_{in}$, and an output terminal 12 for outputting the output potential $V_{out}$. An n-channel field effect transistor (nMOS) 13 as a power switch section is connected between the input terminal 11 and the output terminal 12. Namely a drain electrode 13*d* of the nMOS 13 is connected to the input terminal 11, and a source electrode 13*s* of the nMOS 13 is connected to the output terminal 12. The power switch section constituted by the nMOS 13 varies its resistance in response to a control potential inputted to a gate electrode 13*g*. The term "connected" used herein means not only fixed and short-circuit connection by a wiring and the like, but also connection via a switch element, resistance element and the like.

Two resistances 14 and 15 are connected in series in this order between the output terminal 12 and a baseline potential, such as ground potential GND. Two resistances 16 and 17 are connected in series in this order between the gate electrode 13*g* of the nMOS 13 and the baseline potential, such as ground potential GND. Although the baseline potential is illustratively the ground potential GND in this embodiment, the baseline potential is not limited to the ground potential.

Furthermore, the power supply circuit 1 includes an error amplifier 20. The error amplifier 20 includes a negative side input portion 20*a*, a positive side input portion 20*b*, and an output portion 20*c*. The error amplifier 20 compares the potential inputted to the negative side input portion 20*a* and the potential inputted to the positive side input portion 20*b*. The error amplifier 20 amplifies the difference between the potentials and outputs the amplified difference from the output portion 20*c*. The error amplifier 20 makes the potential outputted from the output portion 20*c* high, so that the potential inputted to the positive side input portion 20*b* relative to the potential inputted to the negative side input portion 20*a* is high. The negative side input portion 20*a* of the error amplifier 20 is connected to a connection node 18 between the resistance 14 and the resistance 15. The output portion 20*c* is connected to a connection node 19 between the resistance 16 and the resistance 17. That is, the negative side input portion 20*a* is connected to the output terminal 12 via the resistance 14, and the output portion 20*c* is connected to the gate electrode 13*g* of the nMOS 13 via the resistance 16.

Moreover, the power supply circuit 1 includes a soft-start circuit 22. As described later, the soft-start circuit 22 controls a startup of the nMOS 13, and also resets the startup of the nMOS 13 when the supply potential $V_{spply}$ ceases to be supplied to the input terminal 11. The soft-start circuit 22 includes a reference terminal 23 inputted a reference potential $V_{ref}$. The reference potential $V_{ref}$ is a constant potential generated by supplying of the supply potential $V_{spply}$ to the power supply circuit 1. The reference potential $V_{ref}$ is lower than the supply potential $V_{spply}$ and the set potential $V_{set}$. For example, the reference potential $V_{ref}$ is 0.9 V.

The soft-start circuit 22 includes a wiring 24. The reference terminal 23 is connected to the positive side input portion 20*b* of the error amplifier 20 by the wiring 24. The wiring 24 is given a resistance R. The resistance R includes an intentionally provided resistance and an inevitable wiring resistance. Furthermore, a capacitance C is given between the wiring 24 and the ground potential GND. The capacitance C includes an intentionally provided capacitance and an inevitable parasitic capacitance. The potential of the wiring 24 is referred to as wiring potential $V_w$.

The soft-start circuit 22 includes a reset switch section 26. The reset switch section 26 includes a buffer 27 and a switch circuit 28. An input end of the buffer 27 is connected to the input terminal 11, and an output end of the buffer 27 is connected to the switch circuit 28. The buffer 27 is supplied with the power supply potential and the ground potential. The buffer 27 outputs a signal of high level H (power supply potential) as an external input signal $V_g$ from the output end when the potential applied to the input end is higher than a prescribed value. And the buffer 27 outputs a signal of low level L (ground potential) as the external input signal $V_g$ from the output end when the potential applied to the input end is lower than the prescribed value. Thus, the buffer 27 outputs high level when the input terminal 11 is supplied with the supply potential $V_{spply}$ as the input potential $V_{in}$. And the buffer 27 outputs low level when the input terminal 11 is not supplied with the supply potential $V_{spply}$.

One terminal 28*a* of the switch circuit 28 is connected to the wiring 24, and the other terminal 28*b* is connected to the ground potential GND. The switch circuit 28 turns the path between the terminal 28*a* and the terminal 28*b* into the non-conducting state (off-state) when the external input signal $V_g$ of high level is inputted from the buffer 27. And the switch circuit 28 turns the path between the terminal 28*a* and the terminal 28*b* into the conducting state (on-state) when the external input signal $V_g$ of low level is inputted.

Next, an operation of the power supply circuit according to this embodiment is described.

FIGS. 2A to 2F are timing charts illustrating the variation of potentials, where the horizontal axis represents time, and the vertical axis represents the potential of each portion of the power supply circuit.

In addition to potentials in the power supply circuit according to this embodiment, FIGS. 2A to 2F also show potentials in a power supply circuit according to a comparative example. The power supply circuit according to the comparative example is a circuit obtained by eliminating the reset switch section 26 from the power supply circuit 1 shown in FIG. 1. In FIGS. 2A to 2F, FIG. 2A shows the input potential $V_{in}$, FIG. 2B shows the external input signal $V_g$, FIG. 2C shows the wiring potential $V_w$ of the comparative example, FIG. 2D shows the wiring potential $V_w$ of this embodiment, FIG. 2E shows the output potential $V_{out}$ of the comparative example, and FIG. 2F shows the output potential $V_{out}$ of this embodiment. In the following, the operation of the power supply circuit 1 is described with reference to FIGS. 1 and 2A to 2F.

First, one state of the power supply circuit 1 is described. The input terminal 11 of the power supply circuit 1 is not supplied with the supply potential $V_{spply}$, i.e., the input potential $V_{in}$ of the input terminal 11 is 0 V or the input terminal 11 is floating at this state.

As shown in the period $t_A$ of FIGS. 2A to 2F, in this case, the potential at the input end of the buffer 27 is also set to 0 V or placed in the floating state. Hence, a signal of low level L is outputted as the external input signal $V_g$ from the output end of the buffer 27. Thus, the switch circuit 28 is turned into the conducting state (ON), and the terminal 28*a* is connected to the terminal 28*b*. However, in the state in which the power supply circuit 1 is not supplied with the supply potential $V_{spply}$, the reference terminal 23 is also not supplied with the reference potential $V_{ref}$. Hence, no current flows in the wiring 24 and the switch circuit 28, and the wiring potential $V_w$ of the wiring 24 is the ground potential (0 V).

On the other hand, because the gate electrode 13*g* of the nMOS 13 is applied with the ground potential (GND), the nMOS 13 is in the non-conducting state. Furthermore, because the output terminal 12 is connected to the ground potential via the resistance 14 and the resistance 15, the potential of the output terminal 12 and the connection node 18 is also the ground potential. Hence, the negative side input portion 20*a* of the error amplifier 20 connected to the connection node 18 is applied with the ground potential. The positive side input portion 20*b* of the error amplifier 20 connected to the wiring 24 is also applied with the ground potential. Thus, the output portion 20*c* of the error amplifier 20 does not output potential.

Next, the case where the input terminal 11 of the power supply circuit 1 is intermittently supplied with the supply potential $V_{spply}$ is described. For instance, it is assumed that users of the cellular phone including the power supply circuit 1 insert the plug of the adaptor into the recharging terminal of the cellular phone to recharge the cellular phone. In this case, the connection state between the plug and the recharging terminal becomes unstable when the users insert the plug into the recharging terminal. Hence the supply potential $V_{spply}$ is intermittently inputted to the input terminal 11 of the power supply circuit 1.

As shown in the period $t_B$ of FIGS. 2A to 2F, when the plug of the adaptor is brought into contact with the recharging terminal of the cellular phone, the input terminal 11 is supplied with the supply potential $V_{spply}$ as the input potential $V_{in}$. Thus, the input end of the buffer 27 is also supplied with the supply potential $V_{spply}$, and a signal of high level H is outputted as the external input signal $V_g$ from the output end of the buffer 27. Accordingly, the switch circuit 28 is turned into the non-conducting state (OFF), and the terminal 28*a* is isolated from the terminal 28*b*.

Furthermore, the reference terminal 23 is supplied with the reference potential $V_{ref}$. At this time, the wiring 24 includes the resistance R and the capacitance C. So, the wiring potential $V_w$ of the wiring 24 gradually increases from the ground potential toward the reference potential $V_{ref}$ in accordance with the time constant Δt determined by the resistance R and the capacitance C. When the wiring potential $V_w$ inputted to the positive side input portion 20*b* gradually increases relative to the potential of the connection node 18 inputted to the negative side input portion 20*a*, the potential outputted from the output portion 20*c* gradually increases. Thus, the control potential inputted to the gate electrode 13*g* of the nMOS 13 increases. Hence, a state of the nMOS 13 gradually transitions to the conducting state, and the source-drain resistance of the nMOS 13 gradually decreases. Consequently, the output potential $V_{out}$ of the output terminal 12 also gradually increases. In response thereto, the potential of the connection node 18 also increases. And the potential of the connection node 18 is fed back to the negative side input portion 20*a* of the error amplifier 20.

That is, the wiring potential $V_w$ inputted to the positive side input portion 20*b* of the error amplifier 20 gradually increases. And also, the potential inputted to the negative side input portion 20*a* in accordance with the output potential $V_{out}$ gradually increases. At this time, if the increase of the output potential $V_{out}$ lags behind the increase of the wiring potential $V_w$, the potential of the negative side input portion 20*a* becomes lower than the potential of the positive side input portion 20*b* of the error amplifier 20. Thus the potential outputted from the output portion 20*c* increases. The resistance of the nMOS 13 decreases. And the increase of the output potential $V_{out}$ of the output terminal 12 is accelerated.

On the other hand, if the increase of the output potential $V_{out}$ precedes the increase of the wiring potential $V_w$, the potential of the negative side input portion 20*a* becomes higher than the potential of the positive side input portion 20*b* of the error amplifier 20. Thus the potential outputted from the output portion 20*c* decreases. The resistance of the nMOS 13 increases. And the increase of the output potential $V_{out}$ of the output terminal 12 is suppressed. Thus, the error amplifier 20 outputs the control potential via the output portion 20*c*. The error amplifier 20 makes the source-drain resistance of the nMOS 13 high by the control potential so that the potential applied to the negative side input portion 20*a* is high relative to the potential applied to the positive side input portion 20*b*. Consequently, negative feedback with reference to the wiring potential $V_w$ is applied to the output potential $V_{out}$. And the output potential $V_{out}$ gradually increases in accordance with the time constant Δt. Thus, in the period $t_B$, no inrush voltage occurs in the power supply circuit 1.

Subsequently, as shown in the period $t_C$ of FIGS. 2A to 2F, the plug of the adaptor loses contact with the recharging terminal of the cellular phone, and the supply of the supply potential $V_{spply}$ to the input terminal 11 is suspended. Then, the output potential $V_{out}$ turns to the ground potential (0 V), and the potential inputted to the negative side input portion 20*a* of the error amplifier 20 also turns to the ground potential. Furthermore, the supply of the reference potential $V_{ref}$ is also stopped. Moreover, the capacitance C accumulates a certain amount of charge immediately before suspension of the supply of the supply potential $V_{spply}$. So far the operation of this embodiment including the reset switch section 26 is same the operation of the comparative example lacking the reset switch section 26.

However, in the comparative example, even if the supply of the reference potential $V_{ref}$ is stopped, the wiring potential $V_w$ of the wiring 24 does not immediately turn to the ground potential because of the charge accumulated in the capacitance C. The wiring potential $V_w$ gradually decreases by spontaneous discharge of the capacitance C. Then, as shown in the period $t_D$ of FIGS. 2A to 2F, before the wiring potential $V_w$ turns to the ground potential, the supply potential $V_{spply}$ is supplied again to the input terminal 11. Then, the wiring potential $V_w$ starts to increase from a higher potential than the ground potential. On the other hand, the potential of the connection node 18 is the ground potential. Hence, the potential of the positive side input portion 20*b* becomes significantly higher than the potential of the negative side input portion 20*a* of the error amplifier 20. Thus the potential outputted from the output portion 20*c* also becomes higher. And a state of the nMOS 13 sharply transitions to the conducting state. Thus, an excessive current flows in the nMOS 13, an inrush voltage generates at the output terminal 12, and the output potential $V_{out}$ temporarily exceeds the set potential $V_{set}$. Consequently the rechargeable battery (not shown) connected to the output terminal 12 is damaged.

In contrast, in this embodiment, a reset switch section 26 is provided. Hence, as shown in the period $t_C$ of FIGS. 2A to 2F, when the plug of the adaptor loses contact with the recharging terminal of the cellular phone, and the supply of the supply potential $V_{spply}$ to the input terminal 11 is suspended, then the external input signal $V_g$ of low level L is outputted from the output end of the buffer 27, and the switch circuit 28 is turned into the conducting state. Thus, the wiring 24 is connected to the ground potential GND via the switch circuit 28. The charge accumulated in the capacitance C is rapidly discharged to the ground potential GND via the wiring 24 and the switch circuit 28. And the wiring potential $V_w$ quickly turns to the ground potential. Consequently, as shown in the period $t_D$ of FIGS. 2A to 2F, even if the supply potential $V_{spply}$ is supplied again to the input terminal 11, the wiring potential $V_w$ starts to increase from the ground potential as in the period $t_B$, and hence no inrush voltage occurs. Subsequently, as shown in the period $t_E$, the supply potential $V_{spply}$ is continuously supplied to the input terminal 11. Thus, the power supply circuit 1 is placed in the steady state when the output potential $V_{out}$ reaches the set potential $V_{set}$. And the output potential $V_{out}$ is fixed to the set potential $V_{set}$.

Next, an effect of this embodiment is described.

According to this embodiment, the power supply circuit 1 has the soft-start circuit 22 and the error amplifier 20. Thus the power supply circuit 1 can adjust the output potential $V_{out}$ to the set potential $V_{set}$, even if the supply potential $V_{spply}$ is unknown. Furthermore, the soft-start circuit 22 and the error amplifier 20 can control the startup of the nMOS 13 for soft-start in accordance with the time constant Δt determined by the resistance R and the capacitance C.

Furthermore, as described above, the comparative example lacks the reset switch section 26. Therefore, in the case where the supply potential $V_{spply}$ is intermittently supplied to the input terminal 11, if the supply potential $V_{spply}$ is newly applied before completion of spontaneous discharge of the capacitance C, an inrush voltage occurs. In contrast, in this embodiment, the reset switch section 26 is turned into the conducting state when the supply of the supply potential $V_{spply}$ is stopped. And the charge accumulated in the capacitance C is forcibly discharged. Hence the wiring potential $V_w$ is reset each time. Thus, even if the supply potential $V_{spply}$ is supplied again, no inrush voltage occurs. Consequently, even in such a situation in which the connection state between the plug of the adaptor and the recharging terminal of the cellular phone becomes unstable, no damage is caused to the inside of the cellular phone. Furthermore, according to this embodiment, the adjustment of the output potential $V_{out}$ and the resetting of the wiring potential $V_w$ described above can be automatically performed without requiring the user's operation.

Next, examples of this embodiment are described.

At the outset, a first example is described.

Figure 3:
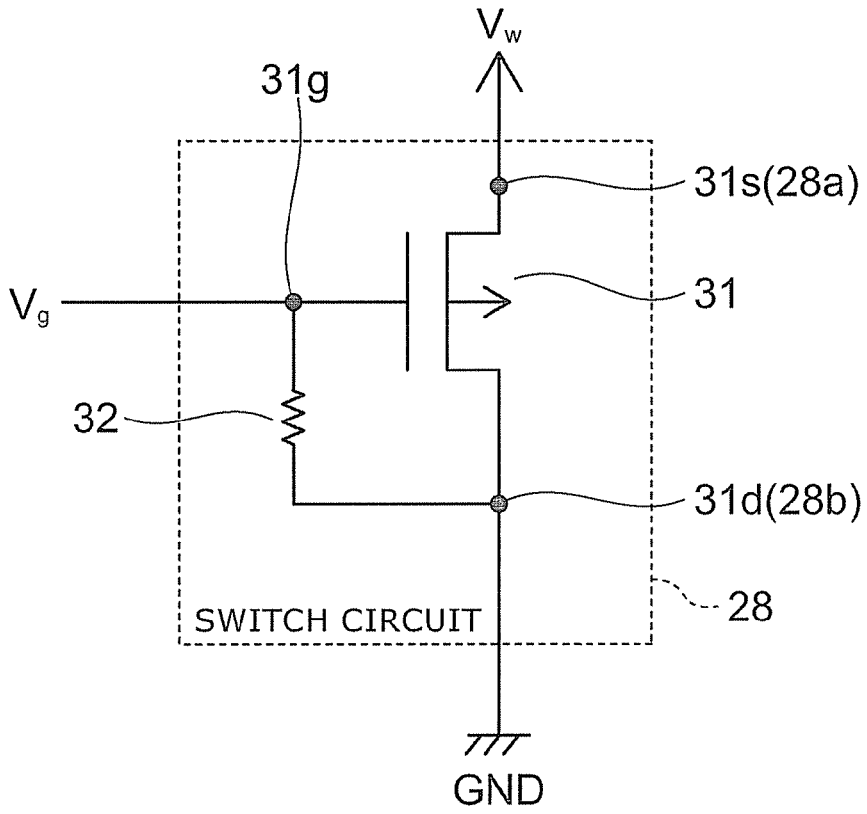
FIG. 3 is a circuit diagram illustrating a switch circuit in a first example of the first embodiment.

FIG. 3 is a circuit diagram illustrating a switch circuit in this example.

As shown in FIG. 3, in this example, the switch circuit 28 is made of a pull-down p-channel field effect transistor (pMOS) 31. The pMOS 31 includes a source electrode 31*s*, a drain electrode 31*d* and a gate electrode 31*g*. The source electrode 31*s* constitutes a terminal 28*a* and is connected to the wiring 24 (see FIG. 1). The drain electrode 31*d* constitutes a terminal 28*b* and is connected to the ground potential GND.

And the gate electrode 31*g* is connected to the output end of the buffer 27 (see FIG. 1). Furthermore, the gate electrode 31*g* of the pMOS 31 is connected to the drain electrode 31*d* via a resistance 32.

In this example, the external input signal $V_g$ outputted from the output end of the buffer 27 is applied to the gate electrode 31*g* of the pMOS 31. Hence, when the external input signal $V_g$ is high level, the pMOS 31 is turned into the non-conducting state. On the other hand, when the external input signal $V_g$ is low level, the pMOS 31 is turned into the conducting state. Furthermore, when no potential is externally supplied to the power supply circuit, the gate electrode 31*g* of the pMOS 31 is applied with the ground potential via the resistance 32. Hence the pMOS 31 is turned into the conducting state. Thus, the switch circuit 28 can be realized.

Next, a second example is described.

Figure 4:
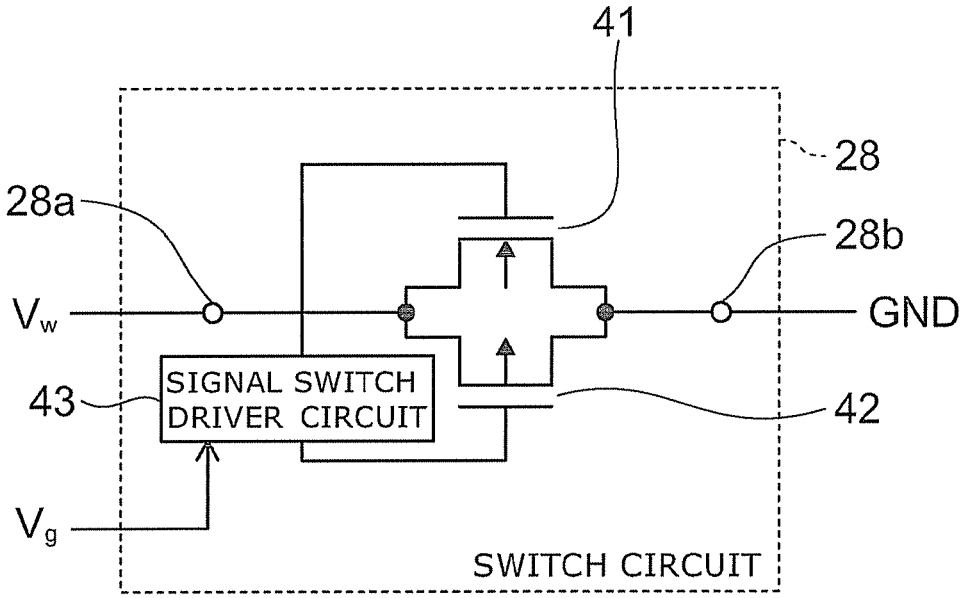
FIG. 4 is a circuit diagram illustrating a switch circuit in a second example of the first embodiment.

FIG. 4 is a circuit diagram illustrating a switch circuit in this example.

As shown in FIG. 4, in this example, the switch circuit 28 includes an nMOS 41, a pMOS 42, and a signal switch driver circuit 43. More specifically, the drain electrode of the nMOS 41 and the source electrode of the pMOS 42 are commonly connected to the terminal 28*a*. And the source electrode of the nMOS 41 and the drain electrode of the pMOS 42 are commonly connected to the terminal 28*b*. Furthermore, the signal switch driver circuit 43 is configured to receive the external input signal $V_g$, and to independently output an output signal to each of the gate electrode of the nMOS 41 and the gate electrode of the pMOS 42. The signal switch driver circuit 43 is a logic circuit. The signal switch driver circuit 43 applies a negative potential to the gate electrode of the nMOS 41 and a positive potential to the gate electrode of the pMOS 42 in response to input of the external input signal $V_g$ of high level. And the signal switch driver circuit 43 applies a positive potential to the gate electrode of the nMOS 41 and a negative potential to the gate electrode of the pMOS 42 in response to input of the external input signal $V_g$ of low level.

In this example, when the external input signal $V_g$ of high level is outputted from the output end of the buffer 27, the signal switch driver circuit 43 applies a negative potential to the gate electrode of the nMOS 41 and a positive potential to the gate electrode of the pMOS 42 to turn both the nMOS 41 and the pMOS 42 into the non-conducting state. Thus, the terminal 28*a* is electrically cut off from the terminal 28*b*. On the other hand, when the external input signal $V_g$ of low level is outputted, the signal switch driver circuit 43 applies a positive potential to the gate electrode of the nMOS 41 and a negative potential to the gate electrode of the pMOS 42 to turn both the nMOS 41 and the pMOS 42 into the conducting state. Thus, the terminal 28*a* is connected to the terminal 28*b*. Therefore, the switch circuit 28 can be realized.

Next, a second embodiment is described.

Figure 5:
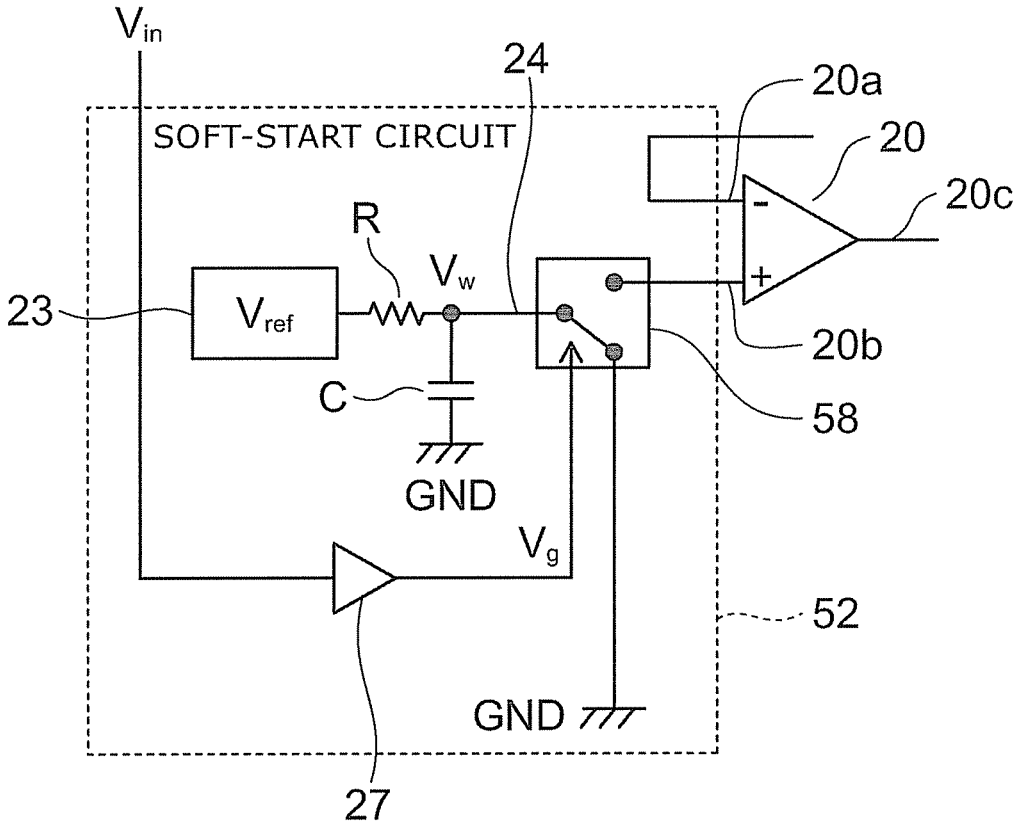
FIG. 5 is a circuit diagram illustrating a soft-start circuit and an error amplifier of a power supply circuit according to a second embodiment.

FIG. 5 is a circuit diagram illustrating a soft-start circuit and an error amplifier of a power supply circuit according to this embodiment.

As shown in FIG. 5, the power supply circuit according to this embodiment is different from the power supply circuit 1 (see FIG. 1) according to the above first embodiment in that the soft-start circuit 22 is replaced by a soft-start circuit 52.

The soft-start circuit 52 includes a switch circuit 58 instead of the switch circuit 28 (see FIG. 1). The switch circuit 58 is an analog switch interposed between the wiring 24 and the positive side input portion 20*b* of the error amplifier 20. The switch circuit 58 is configured to switch whether to connect the wiring 24 to the positive side input portion 20*b* or to the ground potential GND. The switch circuit 58 connects the wiring 24 to the positive side input portion 20*b* in response to the external input signal $V_g$ of high level inputted from the buffer 27. And the switch circuit 58 connects the wiring 24 to the ground potential GND in response to the external input signal $V_g$ of low level inputted from the buffer 27. The configuration of this embodiment other than the foregoing is similar to that of the above first embodiment.

Next, an operation and effect of this embodiment are described.

Also in this embodiment, when the supply potential $V_{spply}$ ceases to be supplied to the input terminal 11 (see FIG. 1), the external input signal $V_g$ of low level is outputted from the output end of the buffer 27. Therefore, the switch circuit 58 cuts off the wiring 24 from the positive side input portion 20*b* and connects to the ground potential GND. Consequently, the charge accumulated in the capacitance C is quickly discharged to the ground potential, and the wiring potential $V_w$ of the wiring 24 is quickly returned to the ground potential. Thus, the wiring potential $V_w$ is reset every time when the supply of the supply potential $V_{spply}$ is interrupted. Therefore, an effect similar to that of the above first embodiment is achieved. The operation and effect of this embodiment other than the foregoing are similar to those of the above first embodiment.

Next, a third embodiment is described.

Figure 6:
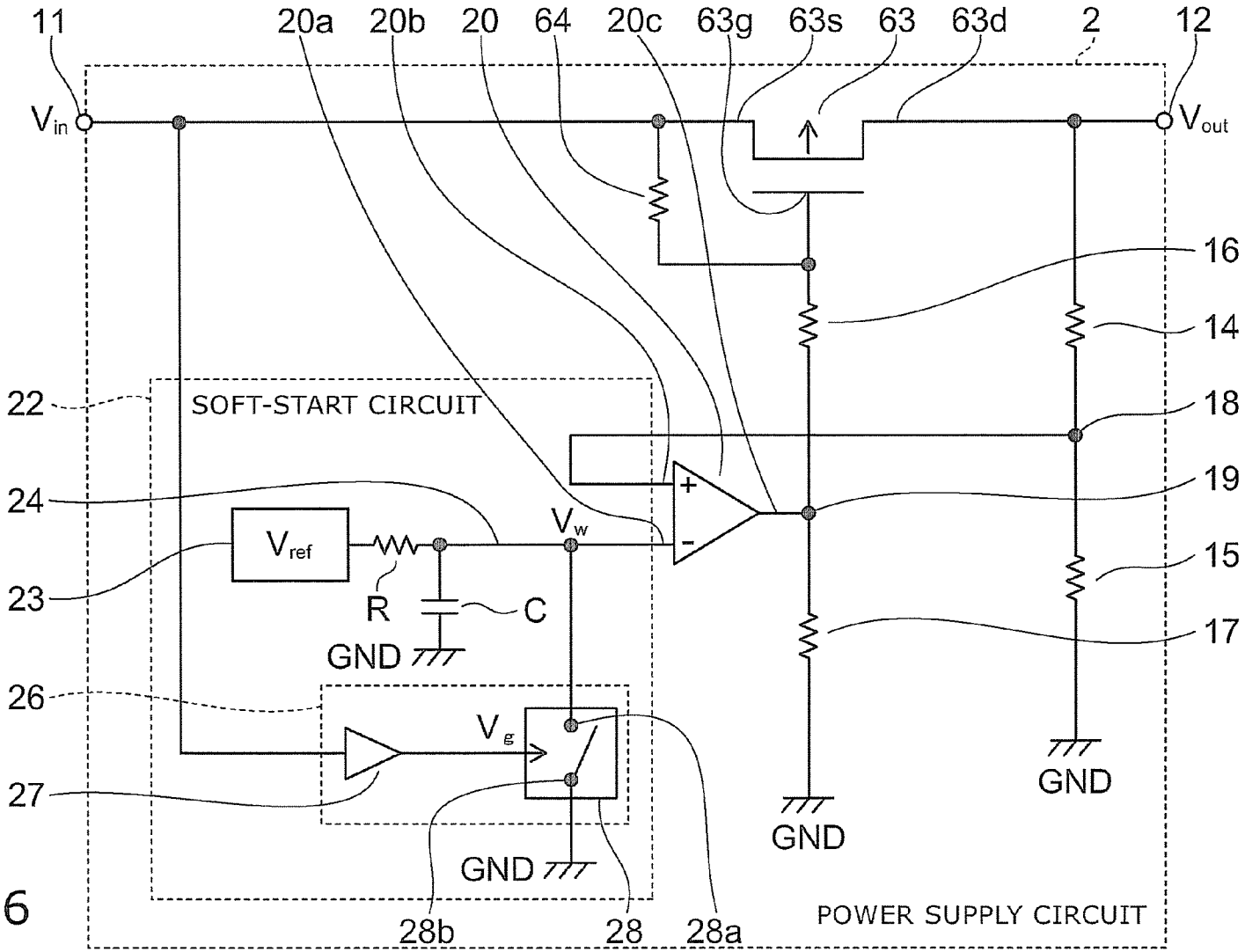
FIG. 6 is a circuit diagram illustrating a power supply circuit according to a third embodiment.

FIG. 6 is a circuit diagram illustrating a power supply circuit according to this embodiment.

As shown in FIG. 6, the power supply circuit 2 according to this embodiment is different from the power supply circuit 1 (see FIG. 1) according to the above first embodiment in that the nMOS 13 is replaced by a pMOS 63. A resistance 64 is connected between the source electrode 63*s* and the gate electrode 63*g* of the pMOS 63. The connection at the negative side input portion 20*a* and the positive side input portion 20*b* of the error amplifier 20 is reversed relative to the above first embodiment. More specifically, the source electrode 63*s* of the pMOS 63 is connected to the input terminal 11, and a drain electrode 63*d* of the pMOS 63 is connected to the output terminal 12. And a negative side input portion 20*a* of the error amplifier 20 is connected to the wiring 24, and a positive side input portion 20*b* of the error amplifier 20 is connected to the connection node 18. The configuration of this embodiment other than the foregoing is similar to that of the above first embodiment.

Next, an operation and effect of this embodiment are described.

In this embodiment, when the supply potential $V_{spply}$ is supplied to the input terminal 11 as the input potential $V_{in}$, the supply potential $V_{spply}$ is also supplied to the gate electrode 63*g* of the pMOS 63 via the resistance 64. Hence the pMOS 63 is initially turned into the non-conducting state. On the other hand, the reference terminal 23 is supplied with the reference potential $V_{ref}$. Hence, the wiring potential $V_w$ of the wiring 24 gradually increases in accordance with the time constant $\Delta t$ determined by the resistance R and the capacitance C.

At this time, if the increase of the output potential $V_{out}$ lags behind the increase of the wiring potential $V_w$, the potential inputted to the positive side input portion 20*b* becomes lower than the potential inputted to the negative side input portion 20*b* of the error amplifier 20. Then the potential outputted from the output portion 20*c* decreases, and the resistance of the pMOS 63 decreases. Thus, the output potential $V_{out}$ starts to increase. On the other hand, if the increase of the output potential $V_{out}$ precedes the increase of the wiring potential $V_w$, the potential inputted to the positive side input portion 20*b* becomes higher than the potential inputted to the negative side input portion 20*a* of the error amplifier 20. Then the potential outputted from the output portion 20*c* increases, and the resistance of the pMOS 63 increases. Thus, the increase of the output potential $V_{out}$ is suppressed. Therefore, the output potential $V_{out}$ is gradually increased while controlling the increasing rate of the output potential $V_{out}$.

Also in this embodiment, as in the above first embodiment, the soft-start circuit 22 includes a reset switch section 26. Thus, the charge accumulated in the capacitance C can be forcibly discharged when the supply of the supply potential $V_{spply}$ is stopped. Therefore, the occurrence of inrush voltage can be prevented. The operation and effect of this embodiment other than the foregoing are similar to those of the above first embodiment.

Next, a fourth embodiment is described.

This embodiment relates to an electronic device, and more particularly to a cellular phone.

Figure 7:
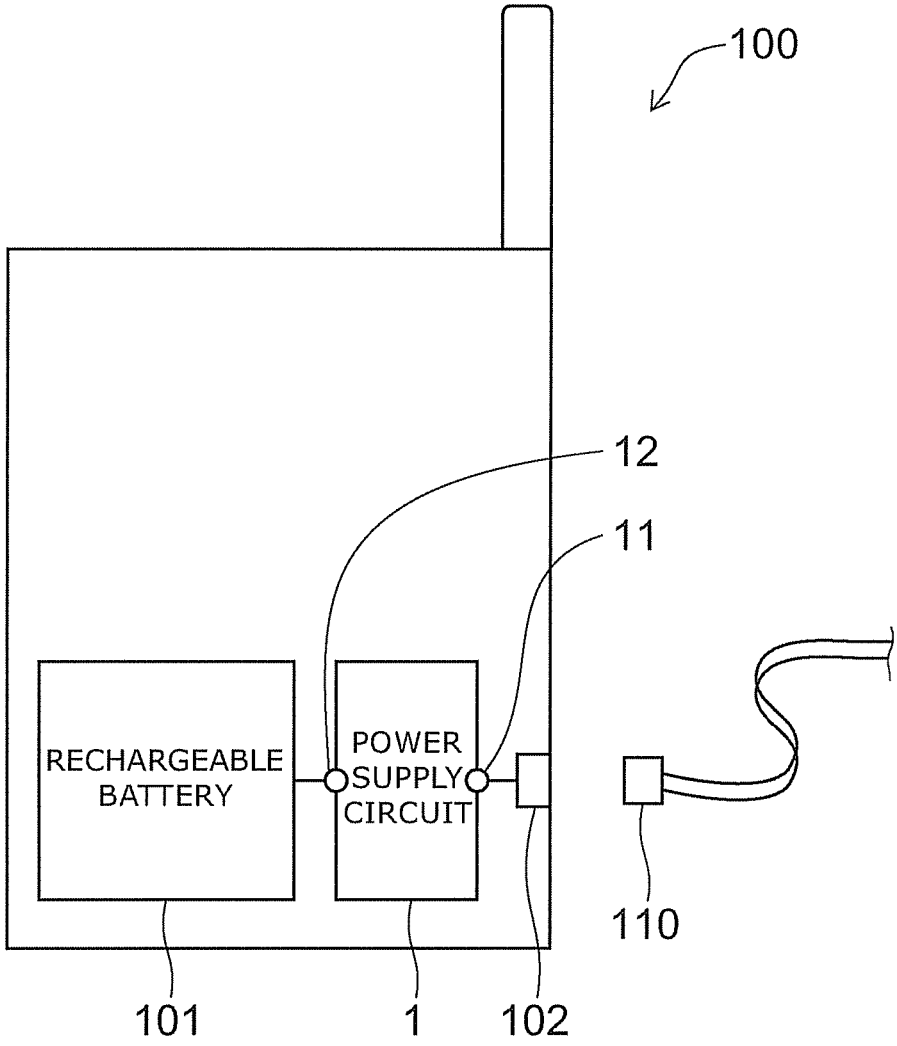
FIG. 7 is a block diagram illustrating a cellular phone according to a fourth embodiment.

FIG. 7 is a block diagram illustrating a cellular phone according to this embodiment.

As shown in FIG. 7, the cellular phone 100 according to this embodiment includes a power supply circuit 1 and a rechargeable battery 101. The configuration of the power supply circuit 1 is similar to that of the power supply circuit 1 according to the above first embodiment. The input terminal 11 of the power supply circuit 1 is connected to the recharging terminal 102 provided on the casing of the cellular phone 100. And the output terminal 12 of the power supply circuit 1 is connected to the rechargeable battery 101. The rechargeable battery 101 is the power supply of the cellular phone 100. On the other hand, a plug 110 of an external power supply is supplied with the supply potential $V_{spply}$.

In this embodiment, the plug 110 of the external power supply is inserted into the recharging terminal 102. Thus, the plug 110 is connected to the recharging terminal 102 by being in contact therewith. And the rechargeable battery 101 is recharged. According to this embodiment, the power supply circuit 1 is provided in the cellular phone 100. Thus, even if the supply potential $V_{spply}$ externally supplied is higher than the prescribed set potential $V_{set}$, it is automatically converted to the set potential $V_{set}$ for supply to the rechargeable battery 101. Thus the rechargeable battery 101 can be recharged. Furthermore, even if the connection state between the plug 110 and the recharging terminal 102 becomes unstable, the rechargeable battery 101 can be protected from inrush voltage by the operation described in the first embodiment. It is noted that, the cellular phone 100 may have the power supply circuit according to the above second or third embodiment.

The invention has been described with reference to the embodiments, but the invention is not limited to these embodiments. The above embodiments can be practiced in combination with each other. Furthermore, those skilled in the art can suitably modify the above embodiments by addition, deletion, or design change of components, and such modifications are also encompassed within the scope of the invention as long as they fall within the spirit of the invention. For instance, while the electronic device is illustratively a cellular phone in the above fourth embodiment, the invention is not limited thereto, but is applicable to any electronic device externally supplied with a power supply voltage. In particular, the invention is suitably applicable to electronic devices with a rechargeable battery installed thereon, including portable electronic devices such as digital still cameras, digital video cameras, notebook personal computers, and audio devices.

The above embodiments can realize a power supply circuit capable of stably outputting a prescribed voltage even in the case where the contact state with the external power supply is unstable, and an electronic device provided therewith.

The invention claimed is:

1. A power supply circuit comprising:

a power switch section connected between an input terminal and an output terminal and configured to vary resistance in response to an inputted control potential;

an error amplifier having one input portion connected to the output terminal, another input portion and an output portion, the error amplifier outputting the control potential via the output portion to make the resistance of the power switch section high so that potential applied to the one input portion is high to potential applied to the another input portion;

a wiring connecting a reference terminal to the another input portion; and a reset switch section configured to disconnect the wiring from a baseline potential when the input terminal is supplied with a potential, and to connect the wiring to the baseline potential when the input terminal is not supplied with the potential.

2. The circuit according to claim 1, wherein the reset switch section includes:

a buffer having an output end and an input end connected to the input terminal, the buffer being configured to output a first potential via the output end when potential applied to the input end is higher than a prescribed value, and to output a second potential via the output end when potential applied to the input end is lower than the prescribed value; and a switch circuit having one terminal connected to the wiring and another terminal connected to the baseline potential, the switch circuit being configured to turn a path between the one terminal and the another terminal into a non-conducting state when the first potential is inputted from the output end of the buffer, and to turn the path between the one terminal and the another terminal into a conducting state when the second potential is inputted from the output end of the buffer.

3. The circuit according to claim 2, wherein the switch circuit is a p-channel field effect transistor, the one terminal is a source electrode of the p-channel field effect transistor, the another terminal is a drain electrode of the p-channel field effect transistor, the output end of the buffer is connected to a gate electrode of the p-channel field effect transistor, and the gate electrode is connected to the drain electrode via a resistance.

4. The circuit according to claim 2, wherein the switch circuit includes:

an n-channel field effect transistor having a drain electrode connected to the one terminal and a source electrode connected to the another terminal;

a p-channel field effect transistor having a source electrode connected to the one terminal and a drain electrode connected to the another terminal; and a signal switch driver circuit configured to apply a negative potential to the gate electrode of the n-channel field effect transistor and a positive potential to the gate electrode of the p-channel field effect transistor when the first potential is applied from the output end of the buffer, and to apply a positive potential to the gate electrode of the n-channel field effect transistor and a negative potential to the gate electrode of the p-channel field effect transistor when the second potential is applied from the output end of the buffer.

5. The circuit according to claim 2, wherein the first potential is higher than the second potential.

6. The circuit according to claim 1, wherein the reset switch section includes:

a buffer having an output end and an input end connected to the input terminal, the buffer being configured to output a first potential from the output end when potential applied to the input end is higher than a prescribed value, and to output a second potential from the output end when potential applied to the input end is lower than the prescribed value; and a switch circuit configured to connect the wiring to the another input section when the first potential is inputted from the output end of the buffer, and to connect the wiring to the baseline potential when the second potential is inputted from the output end of the buffer.

7. The circuit according to claim 6, wherein the first potential is higher than the second potential.

8. The circuit according to claim 1, wherein the power switch section includes an n-channel field effect transistor connected between the input terminal and the output terminal, the output portion of the error amplifier is connected to a gate electrode of the n-channel field effect transistor, and the error amplifier makes potential outputted via the output portion low, so that potential inputted to the one input portion is high to potential inputted to the another input portion.

9. The circuit according to claim 1, wherein the power switch section includes a p-channel field effect transistor connected between the input terminal and the output terminal, the output portion of the error amplifier is connected to a gate electrode of the p-channel field effect transistor, and the error amplifier makes potential outputted via the output portion high, so that potential inputted to the one input portion is high to potential inputted to the another input portion.

10. An electronic device comprising:

a power supply circuit; and a rechargeable battery connected to an output terminal of the power supply circuit the power supply circuit including:

a power switch section connected between an input terminal and an output terminal and configured to vary resistance in response to an inputted control potential;

an error amplifier having one input portion connected to the output terminal, another input portion and an output portion, the error amplifier outputting the control potential via the output portion to make the resistance of the power switch section high so that potential applied to the one input portion is high to potential applied to the another input portion;

a wiring connecting the another input portion to a reference terminal; and a reset switch section configured to disconnect the wiring from a baseline potential when the input terminal is supplied with a potential, and to connect the wiring to the baseline potential when the input terminal is not supplied with the potential.

11. The device according to claim 10, further comprising:

a recharging terminal connected to the input terminal and configured to be connected to a plug of an external power supply by being in contact with the plug.

12. The device according to claim 11, wherein the plug is inserted into the recharging terminal.

13. The device according to claim 10, wherein the device is a cellular phone.

* * * * *